United States Patent [19]

Farr

[11] 4,061,321

[45] Dec. 6, 1977

[54] FRAME HOLDER

[76] Inventor: William Farr, 8445 S. Lawler Ave., Burbank, Ill. 60459

[21] Appl. No.: 766,901

[22] Filed: Feb. 9, 1977

[51] Int. Cl.[2] ..... B25B 1/20

[52] U.S. Cl. ..... 269/41; 269/228

[58] Field of Search ..... 269/41, 42, 104, 107, 269/157, 161, 254 R, 218, 228

[56] References Cited

U.S. PATENT DOCUMENTS 3,944,200 3/1976 Huntley ..... 269/42

*Primary Examiner*—Robert C. Watson

*Attorney, Agent, or Firm*—John J. Kowalik

[57] ABSTRACT

A novel holder for work pieces, particularly for holding picture frame pieces in which the adjoining mitered ends of the frame pieces are brought together. The inventive concept resides in providing a mechanism which permits primary adjustment of the jaws in such manner that the pieces are easy to insert and wherein as the last increment of movement of the jaws they tightly clamp the pieces and move them endwise toward each other in perfect alignment and after nailing; the mechanism also quickly releases the joined frame pieces because of the electrical toggle linkage employed.

6 Claims, 12 Drawing Figures

FIG. 4b
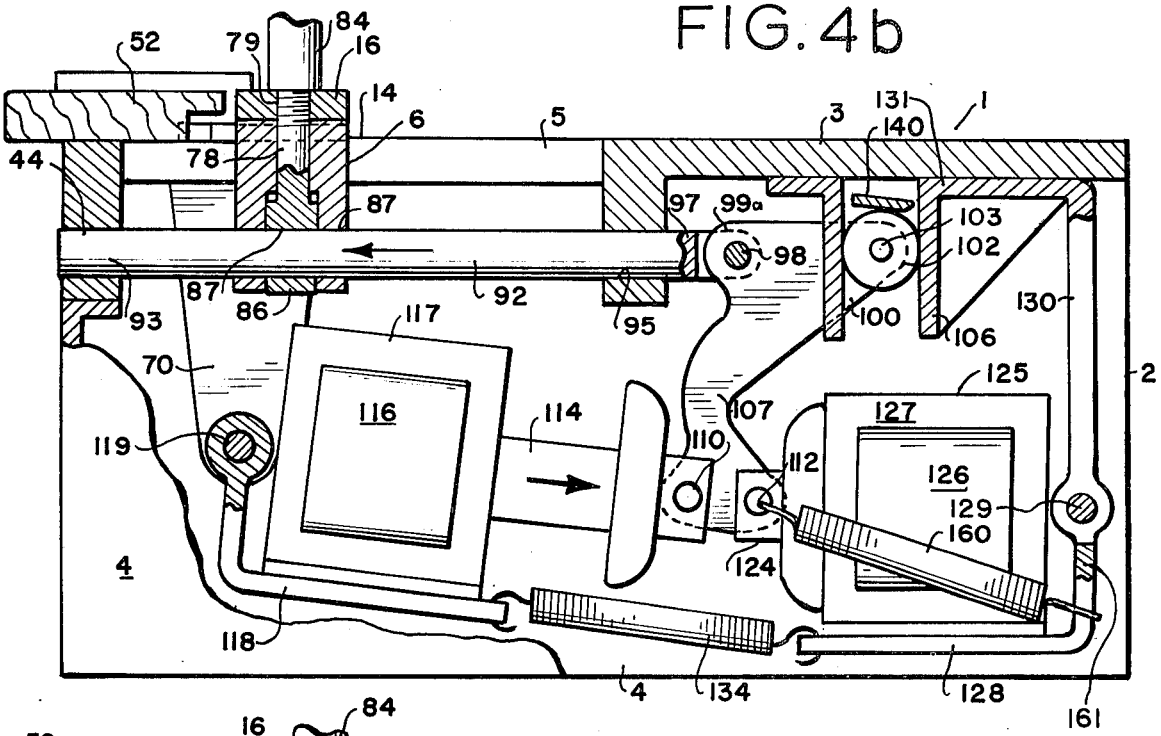
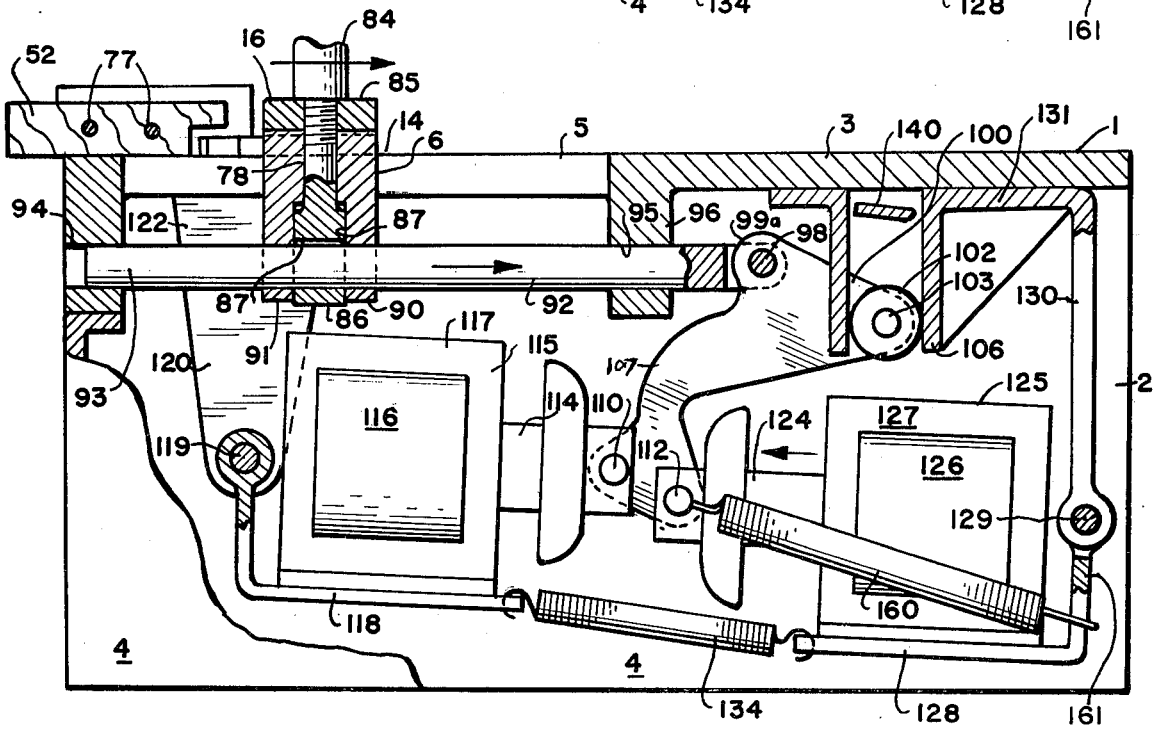
FIG. 4c

FRAME HOLDER

DISCUSSION OF THE PRIOR ART

Various jigs and clamps are available to hold such picture frame pieces together. However, they involve tedious manipulation not only of the frame pieces, but also require simultaneous adjustments and tightening of the clamps. This greatly hampers production since the mechanism must be released from the nailed pieces, then the new pieces reinserted, and while trying to hold the pieces in proper relation, the clamps must be tightened. This is frustrating and time consuming and requires experience and dexterity.

SUMMARY OF THE INVENTION

This invention is directed to providing a mechanism for clamping work pieces such as picture frames in a desired angle in such manner that the mitered surfaces meet in a perfectly aligned position and are squeezed together.

The invention has for its main objective to provide a simple and effective clamping mechanism incorporating all of the actuating components in a simplified electrically operated linkage without the necessity of providing auxiliary power such as air compressors and the like.

The invention embodies a plurality of solenoids arranged in a toggle which are excited through a foot switch, the toggle arrangement providing a simple but effective mechanism for temporarily locking the clamping jaws tightly with the frame members during nailing thereof.

A further object is to provide a novel calibration switch in the power circuit to prevent accidental activation of the clamping jaws, particularly during adjustment thereof to different widths of frames.

These and other objects inherent in and encompassed by the invention will become more readily apparent from the specification and the drawings, wherein.

Figure 1:
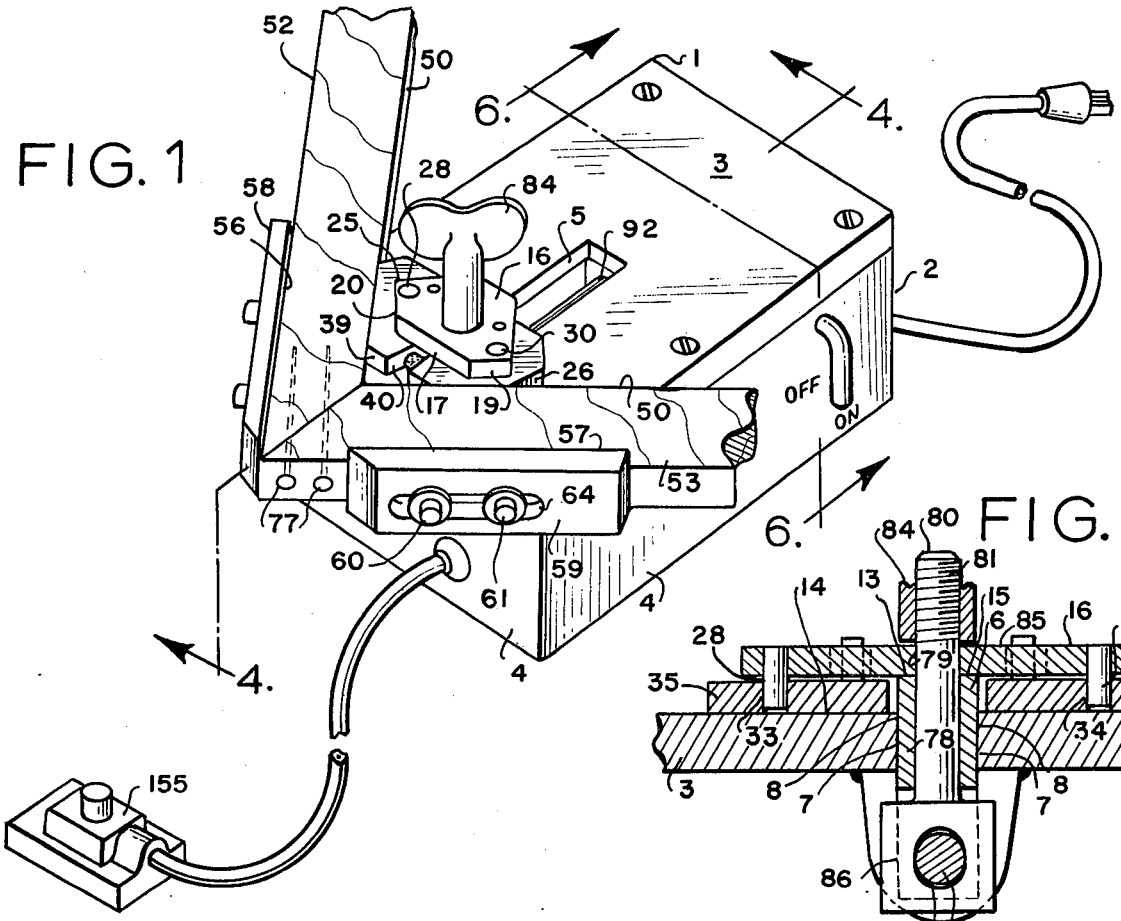
FIG. 1 is a top perspective view of my novel mechanism.
Figure 3:
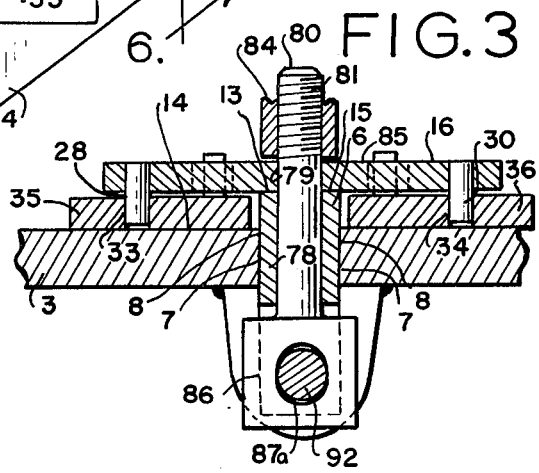
Figure 2:
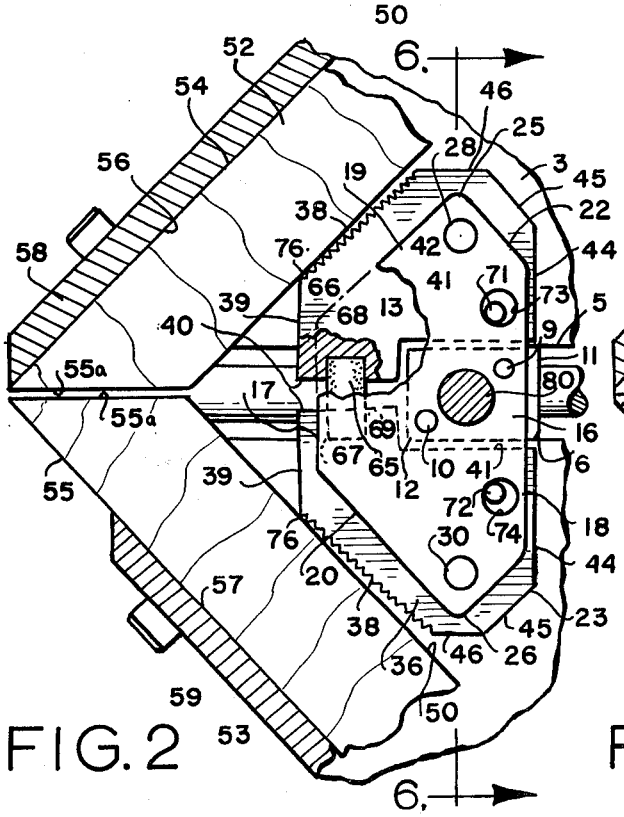
FIG. 2 is an enlarged top plan view with parts broken away and in section of the jaw assembly of the mechanism.
Figure 2A:
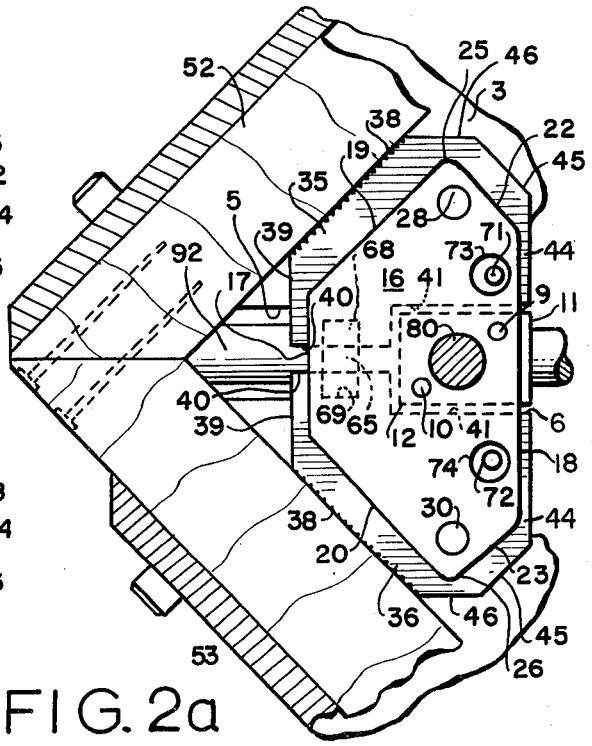
Figure 4:
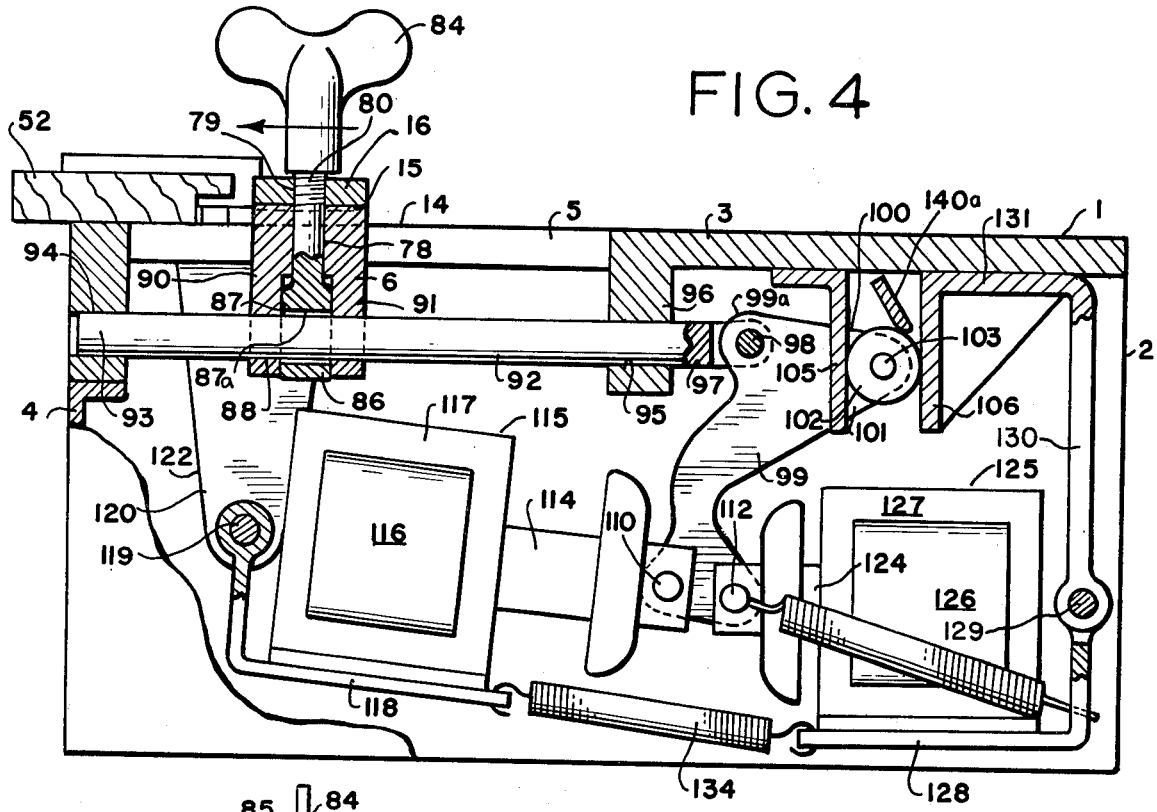
Figure 4A:
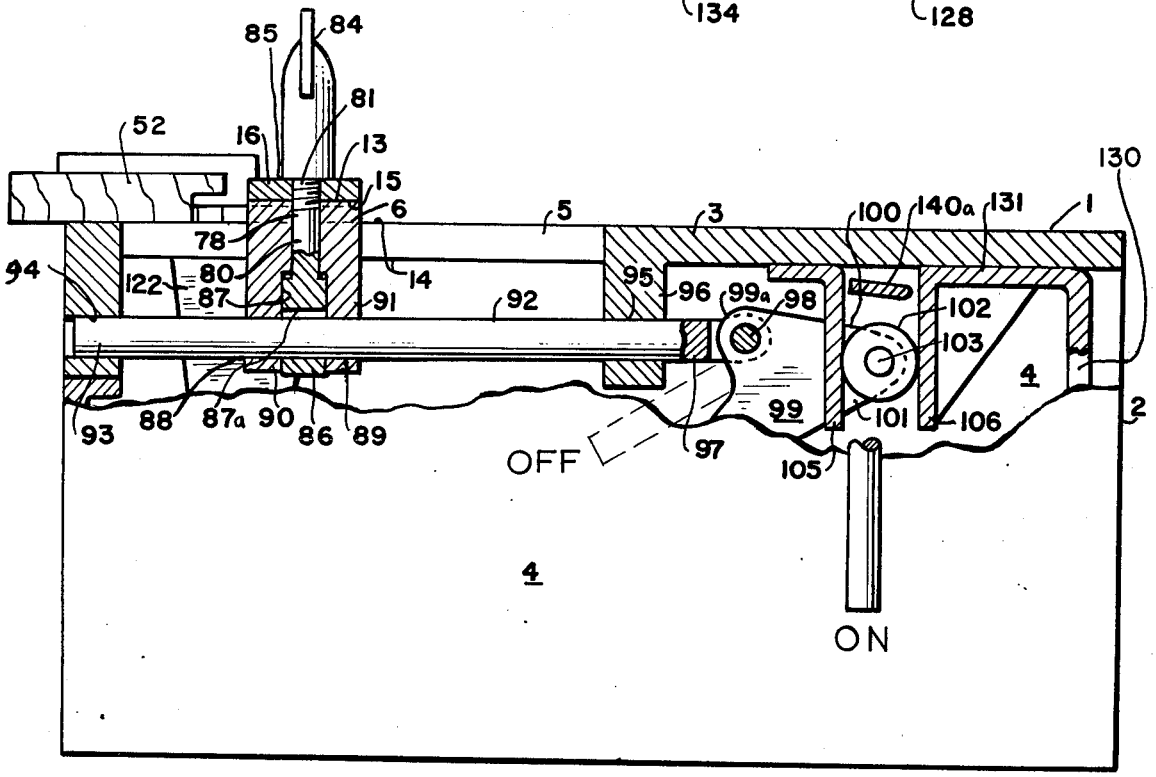
Figure 5:
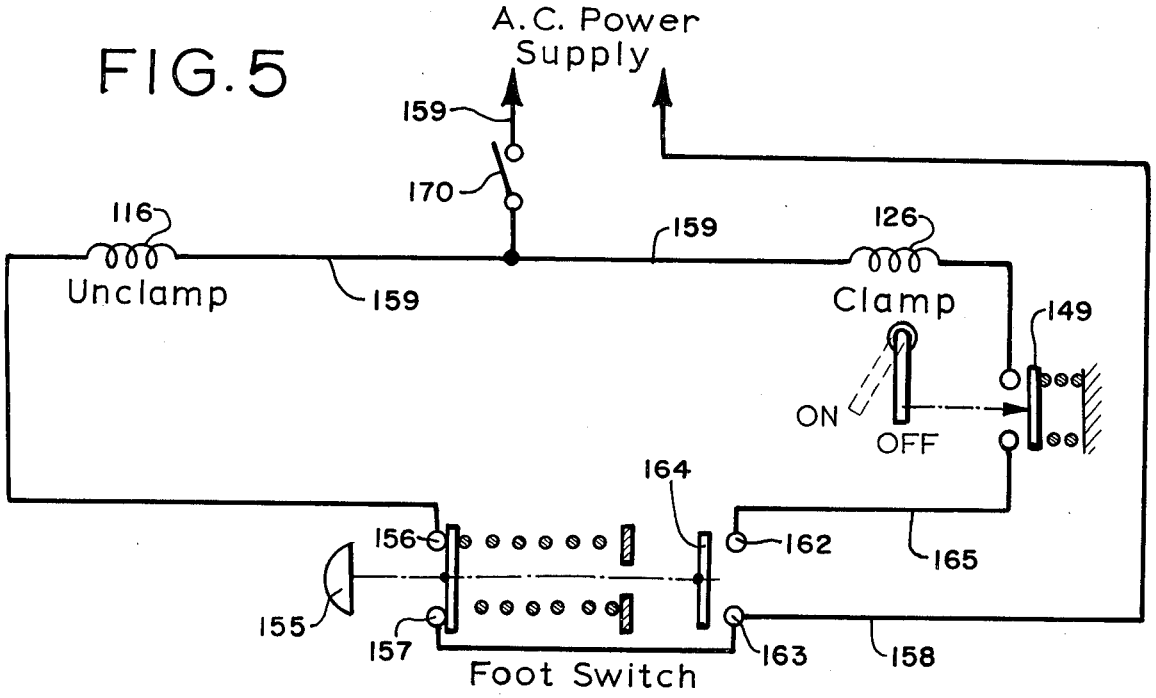
Figure 6:
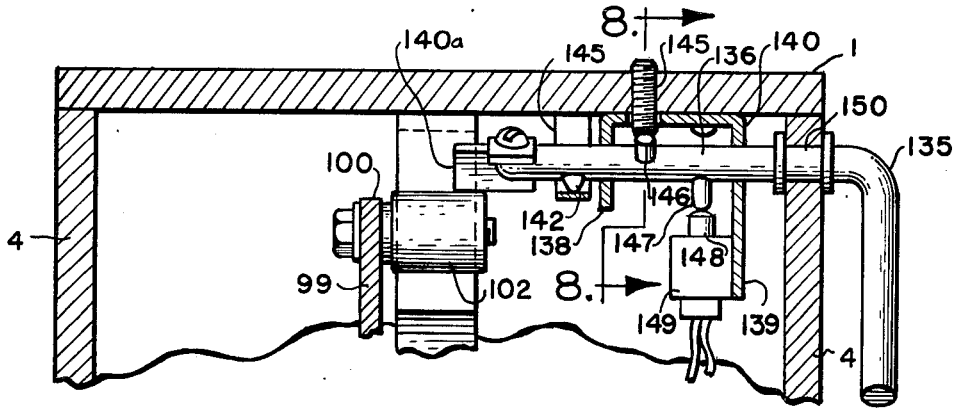

FIG. 2*a* is a top view of the jaw assembly;

FIG. 3 is a cross-sectional view on line 3—3 of FIG. 2;

FIG. 4 is a longitudinal sectional view taken substantially on line 4—4 of FIG. 1, showing the parts with the jaws in unclamped position;

FIG. 4*a* is a side elevational view of the mechanism shown partly in section on line 4—4;

FIG. 4*b* is a cross-sectional view on line 4—4 of FIG. 1, showing the parts with the jaws in clamped position;

FIG. 5 is a diagramatic view of the electric circuit;

FIG. 6 is a cross-section taken on line 6—6 of FIG. 1 with the calibration switch in off position.

Figure 7:
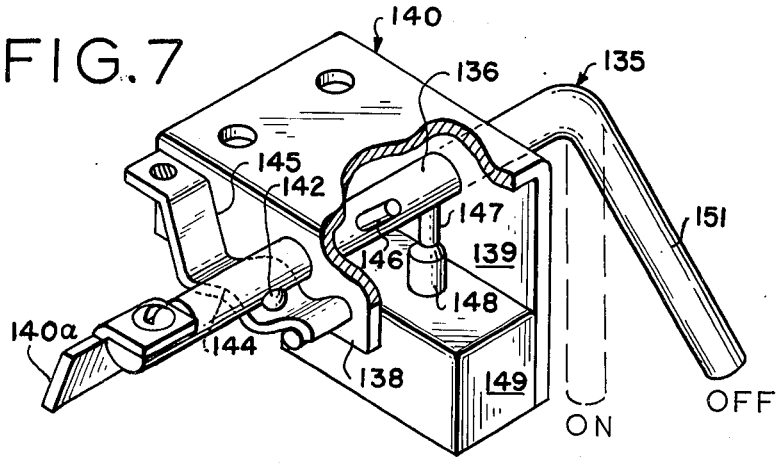
Figure 8:
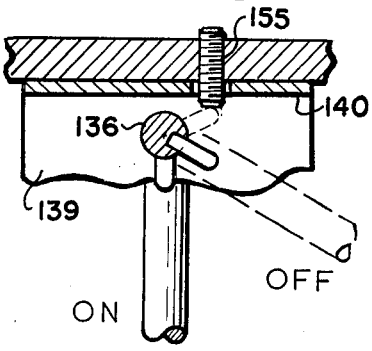

FIG. 7 is a perspective view partly broken away showing the switch and cam control mechanism; and FIG. 8 is a cross-section on line 8—8 of FIG. 6.

DESCRIPTION OF THE INVENTION

The novel frame clamp apparatus is preferably a portable apparatus which includes a casing or housing 2 having a rectangular top wall or table 3 and removably interconnected side walls 4, and if desired a bottom wall (now shown).

The top wall is provided with a longitudinal guide slot 5 in which there is slidably positioned a complimentary quadrilateral guide block 6 having vertical sides 7,7 in close-fitting slidable engagement with the side edges 8,8 (FIG. 3) of the slot 5.

The block 6 has a pair of upstanding locating pins 9,10 positioned at diagonally opposite corners 11,12 thereof projecting upwardly from the horizontal flat top surface 13 of the block.

The block 6 projects above the plane 14 (FIG. 3) of the top wall or table 3 of the mechanism, and with its top surface 13 seats against a flat underface 15 of a mounting plate 16 which is somewhat trapezoidal in top plane and has a short front edge 17, a wide rear or base edge 18, and a pair of side edges 19 and 20 which converge toward and join the opposite ends of the front edge 17. Preferably the rear corners of the side edges 19 and 20 are sheared off and the ends of the base edge 18 are connected to the rear ends of the side edges 19 and 20 by lateral edges 22,23 which diverge forwardly and converge with the respective side edges and merge therewith to form the apices 25,25 which are positioned intermediate the front and rear edges of the mounting or force transmitting plate 16.

At these apices there are provided vertical pins 28,30 which depend below the bottom 15 of the mounting plate and extend into apertures 33,34 in the outer lateral end portions of respective jaw elements 35,35 which are cantilevered from the pins 28,30 to pivot about vertical axes as hereinafter explained. Each jaw is a flat element having a diagonal serrated side edge 38, a forward edge 39 generally paralleling front edge 17 of the mounting plate, an inner side edge 40 which is notched at 41 to accommodate the adjacent front corner 12 or 42 (FIG. 2) of the mounting block, and a rear edge 44 generally parallel with the front edge and a rear diagonal lateral edge 45 converging laterally outwardly toward the rear end of the side edge 38, and joined therewith by a cutoff edge 46. Thus, it will be seen that upon the transmission of force from the slide block 6 to the mounting or transmission plate 16, the respective jaws will pivot about the respective pins 28,30 toward each other at their front ends after engaging the inner edge 50 of the frame pieces 52,53 which are arranged in converging relation and abut each other along their mitered faces 55*a*,55*a*, the outer edges 54,55 of the pieces 52,53 seating against opposing faces 56,57 of guides or stationary jaw elements 58,59, which converge at a right angle with each other and being secured as by set or securing screws 60,61 to table 3. Each jaw element may have a longitudinally elongate slot 64 therein for longitudinal adjustment with reference to the securing screws 60,61 extending therethrough.

It will be readily appreciated that the jaw elements 35,36 are biased apart at their forward ends by means of an elastomer spring 65 such as rubber or neaprene being interposed and compressed therebetween, the ends 66,67 of the spring being pocketed at 68,69 in bores in the opposing inner edges 40 of the jaws. The spreading movement, by one jaw pivoting clockwise and the other counterclockwise is limited by stops 71,72 which are preferably press fitted into apertures in the jaws adjacent to their rear edges in proximity to their respective inner edges, the pins 71,72 extending upwardly with enlarged openings 73,74 in the mounting plate adjacent to its rear edge.

Thus, immediately prior to the jaws 35,36 engaging the rear edges of the frames which have been butted together at their mitered ends 35,36 dispose themselves against the rear edges of the frame pieces in such manner that their serrated edges 38 diverge away from the rear edge of the adjacent frame edge in a direction away from the corner 75 formed by the frame pieces toward the axis of pivot of the jaw. Thus, each jaw has a somewhat point contact at 76,76 (FIG. 2) of its lateral edge with the respective frame piece in the region of the juncture of the side edge with the front edge of the jaw.

As force is applied against the jaws 35,36 they swing about pins 28,30 and advance toward each other at their forward ends, compressing the spring therebetween and concurrently urging the respective frame pieces toward each other along the stationary jaws and tightly engaging the mitered ends **55*a*,55*a* with each other, whereupon the operator hammers in the securing nails 77,77 (FIG. 1). It will be noted that the guide block as well as the mounting plate are provided with vertically aligned holes 78,79 through which extends a securing bolt 80 which is threaded at its free upper end as at 81 upon which there is threaded a wing nut 84 which is adapted to seat against the top side 85 of the mounting plate and tightly engage the bottom side of the plate with the top side of the block. The lower end of bolt 80 is provided with an eye block 86 which is vertically slidable in a guide slot 87 in the lower end of the guide block and open through the lower side thereof. The eye block 86 has a transverse horizontal aperture 87*a* therein which aligns with fore and aft extending apertures 88,89 in front and rear portions 90,91 of the guide block flanking the guide slot 87**.

A push rod 92 extends through apertures 87,88 and 89 and is tightly held to the guide block upon the wing nut being tightened. This mechanism provides an easy adjustment of the movable jaw assembly along the push rod within the longitudinal guide slot to accommodate frames of different widths.

The forward end 93 of the push rod is piloted in a horizontal pilot opening 94 provided in the front wall 4 of the housing. The rear end of the push rod is guided in a horizontal aperture 95 provided in a vertical lug 96, depending from the top wall of the housing at the inner end of the guide slot 5. The rear extremity 97 of the push rod is pivoted by a horizontally extending pin 98 to the elbow **99*a* of a bell crank lever 99 which has a rearwardly extending horizontal leg 100 provided at its distal end 101 with a roller 102 rotatable on a journal pin 103 on a generally horizontal axis, and guided between a pair of vertical opposing front and rear guide tracks 105,106 which depend from the top wall or table 3** of the housing.

The lower end of leg 107 of the lever arm 99 is provided with horizontal front and rear parallel pivots 110,112; the front pivot 110 is connected to the core 114 of a solenoid 115 and extends from a coil 116 thereof, which is mounted in a shell 117. The shell 117 is connected to a hinge arm 118, which is pivoted forwardly of the solenoid 115 on a horizontal pin 119 from the lower end 120 of an anchor 122 which at its upper end is suitably connected to the underside of the table 3, preferably by welding.

The rear pivot 112 is connected to the outer end of the core 124 of the rear solenoid 125, the core extending into the coil 126 which is mounted in a shell 127. The shell 127 is connected to arm 128 which is pivoted on horizontal pivot 129 therebehind from the lower end of anchor 130, which is formed as part of bracket 131 mounted beneath table 3 and which provides the rear guide track 106.

The front and rear solenoids are interconnected via the adjacent ends of the arms 118 and 128 by a tension spring 134 which biases the solenoids toward each other to a position aligning the pivots 110,112 in aligned position, said solenoids serving as a toggle linkage.

A combination control switch operator and manual cam assembly 135 (FIGS. 7 and 8) is provided comprising a horizontal cylindrical rod portion 136 which is journaled in aligned opening in laterally spaced depending flanges 138,139 of bracket 140 fastened to the underside of table 3. The inner end of said rod 136 has a tangentially extending cam element **140*a* which is adapted to ride upon the top of roller 102**.

Inwardly of the inner end of the rod and cam element 141 there is provided on the rod a detent 142 which rides over the lobe 144 of a spring cam 145 to one side or the other thereof. The cam 145 is carried from the flange 138 of bracket 140. The extent of pivotal movement of rod 136 is limited by an adjusting screw 145 which is threaded through the table 3 in position for engagement with a radially extending stop 146 provided on rod 136. Rod 136 also has an actuating finger 147 thereon which is vertically aligned with a switch button 148 of cut-off switch 149 mounted on flange 139 of bracket 140.

The outer end of rod 131 is journaled at 150 from the adjacent side wall 4 of the housing and is connected to an operating handle 151 which parallels the adjacent side wall and is spaced outwardly thereof.

In operation, starting with the handle 151 being in "off" position as seen in phantom lines in FIGS. **4*a* and 8, and in full lines in FIGS. 6 and 7, the cam element 140 is swung down and presses upon the roller 102 swinging the lever 99 in a clockwise direction from the position of FIG. 4*b* to that shown in FIG. 4*c*. This shifts the jaw-actuating push rod 94 rearwardly to the right (FIGS. 4*b*, 4*c*) retracting the movable jaws 35,36** with its mounting and connecting assembly.

In this condition the mounting assembly, namely the block 6, plate 16, and locking screw mechanism 80 are adapted to be unlocked and the jaw assembly slid along the push rod and locked at an adjusted position defining sufficient space to accommodate easy insertion and withdrawal of the frame pieces to be nailed together.

Then the handle 151 is placed in "on" position (see FIGS. 1, 5, and 8). The equipment now is conditioned to be operated by a two-position foot switch 155 which in its released position closes switching contacts 156,157 (FIG. 5) connecting one line 158 of the supply source through the coil 116 solenoid 115 to line 159 of the supply source. The energized coil 116 draws the core 114 forwardly into the coil and moves the lever 99 from position **4*b* to 4*c* stretching the assist return spring 160 which is connected between core 124 of the rear solenoid and the upstanding portion 161 of arm 128, core 124 being extended and the pivots 110,112** being vertically offset from one another, the jaws being retracted.

When the foot switch 155 is depressed the contacts 162,163 are bridged or closed by switch element 164 and current then flows from power supply line 158 through line 165 through closed switch 149 through coil 126 of solenoid 125 and through the second line 159, it being understood that the main switch 170 in line 159 is closed. Upon energizing of the coil 126, the core 124 is retracted, the lever 99 assumes the position of FIG. **4*b*, the pivots 110,112 align and the rush rod 94** moving forwardly with the movable jaws clamps, the frames against the stationary jaws. Release of the font switch automatically retracts the jaws.

It will now be appreciated that a novel effective and fully operative mechanism has been disclosed in a preferred embodiment, and that various modification will become apparent within the scope of the appended claims.

What is claimed is:

1. A clamp comprising opposing relatively movable sets of jaws having opposing clamping faces, at least one set of jaws comprising:

a support: jaw elements pivotally mounted on said support on axes generally parallel with said faces, means yieldably biasing said jaw elements to a position disposing the clamping faces thereon in converging relation to the respective opposing faces, and means for relatively advancing said one set of jaws relative to the other of said sets for clampingly engaging a work piece therebetween and pivoting the jaw elements to substantial parallelism with the opposing jaws and thus shifting the work pieces along the clamping faces, and a support mounting said clamp jaws, means connected to said one set of jaws carried by the support adjusting movement toward and away from the other of said sets of clamp jaws and comprising a pair of solenoids arranged in a toggle linkage interposed between the support and said one set of jaws for selectively clampingly locking said jaws against the work-piece and releasing the same.

2. The invention according to claim 1 and said power means comprising a lever having one end connected to both of said solenoids for actuation thereby, a force-transmitting rod connected to said lever intermediate its ends and to said one set of jaws, and means providing a movable reaction point for the other end of the lever and said support.

3. A clamp comprising opposing relatively movable sets of clamp jaws having opposing clamping faces, means for relatively advancing one set of jaws relative to the other of said sets for engaging a work piece therebetween, said advancing means comprising a pair of opposed solenoids each having a shiftable core opposing the other, means for alternatively energizing said solenoids to open the clamp and to close the clamp, support means for the solenoids, and means including a holding circuit for releasably maintaining said clamp in open position, and means for overriding said holding circuit.

4. The invention according to claim 3 and said advancing means comprising a linkage including power-operated lever means, track means on the support, said lever means including a reaction point including guide means in guided engagement with said track means for controlling movements of said lever means, and means for connecting the lever means at another point to said jaw elements for translating movements of said lever means to said jaw elements.

5. The invention according to claim 4 and power-cut-off means mounted on said support and comprising stop means adapted to limit movement of said guide means and thus position the lever means to hold said clamp in open position.

6. The invention according to claim 5 and said power means comprising said pair of opposed solenoids pivotally mounted on the support and operatively connected at another point to said lever means, and means biasing said solenoids to a position disposing said lever means in jaw-opening position.

* * * * *